US011845588B2

(12) United States Patent
Steele et al.

(10) Patent No.: US 11,845,588 B2
(45) Date of Patent: Dec. 19, 2023

(54) POUCH ENCLOSURE WITH FILLING SLIT

(71) Applicant: Illinois Tool Works Inc., Glenview, IL (US)

(72) Inventors: Mark Steele, New Prague, MN (US); Christopher Ludwig, Buffalo Grove, IL (US); Eric Plourde, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 60 days.

(21) Appl. No.: 17/393,310

(22) Filed: Aug. 3, 2021

(65) Prior Publication Data

US 2022/0041338 A1 Feb. 10, 2022

Related U.S. Application Data

(60) Provisional application No. 63/061,564, filed on Aug. 5, 2020.

(51) Int. Cl.
*B65D 77/10* (2006.01)
*B65D 33/36* (2006.01)
(Continued)

(52) U.S. Cl.
CPC ..... *B65D 33/2508* (2013.01); *B65B 3/17* (2013.01); *B65D 77/10* (2013.01)

(58) Field of Classification Search
CPC ..... B65B 3/17; B65B 3/045; B65D 75/5872; B65D 75/5877; B65D 31/14; B65D 31/147; B65D 77/10
(Continued)

(56) References Cited

U.S. PATENT DOCUMENTS 3,209,984 A * 10/1965 Pelce ..... B65D 31/147 383/44
4,464,790 A * 8/1984 Blankenship ..... B65D 31/147 383/44
(Continued)

FOREIGN PATENT DOCUMENTS

DE 2630793 A1 * 1/1978
EP 0315724 A1 * 5/1989
(Continued)

OTHER PUBLICATIONS

International Search Report and Written Opinion of the International Searching Authority for corresponding Application No. PCT/US2021/044526, dated Nov. 10, 2021, 16 pages.
(Continued)

*Primary Examiner* — Jes F Pascua
*Assistant Examiner* — Nina K Attel
(74) *Attorney, Agent, or Firm* — The Small Patent Law Group LLC; Christopher R. Carroll

(57) ABSTRACT

A filling slit is formed in a first panel of web material of a flexible pouch enclosure formed from the first panel and an opposing second panel of the web material and having a resealable closing assembly having interlocking male and female members joined to a flange. After the flexible pouch enclosure is at least partially filled with a product through an opening in the first panel of the web material that is created by the filling slit, the filling slit is closed by sealing the first panel to the flange of the resealable closing assembly.

16 Claims, 11 Drawing Sheets

(51) Int. Cl.
*B65B 3/17* (2006.01)
*B65D 33/25* (2006.01)

(58) Field of Classification Search
USPC ..... 383/44
See application file for complete search history.

(56) References Cited

U.S. PATENT DOCUMENTS

| | | | | |
|---|---|---|---|---|
| 4,598,529 | A | 7/1986 | Pongrass | |
| 10,329,053 | B2 | 6/2019 | Steele | |
| 2004/0162205 | A1 | 8/2004 | Baker | |
| 2009/0208147 | A1* | 8/2009 | Steele | B65D 31/12 383/38 |
| 2011/0182531 | A1* | 7/2011 | Steele | B65D 31/147 383/41 |

FOREIGN PATENT DOCUMENTS

| | | | |
|---|---|---|---|
| EP | 2457844 | A1 | 5/2012 |
| GB | 867329 | A | 5/1961 |
| JP | H01226556 | A | 9/1989 |
| JP | H0648401 | A | 2/1994 |
| JP | H06312753 | A | 11/1994 |
| JP | 2011131906 | A | 7/2011 |
| JP | 2015217952 | A | 12/2015 |
| JP | 6531407 | B2 | 6/2019 |
| WO | 1989008587 | A1 | 9/1989 |
| WO | 2014061822 | A1 | 4/2014 |

OTHER PUBLICATIONS

International Preliminary Report on Patentability dated Feb. 16, 2023 for corresponding International Application No. PCT/US2021/011526 (11 pages).

* cited by examiner

POUCH ENCLOSURE WITH FILLING SLIT

CROSS-REFERENCE TO RELATED APPLICATIONS

This application claims priority to U.S. Provisional Application No. 63/061,564, which was filed 5 Aug. 2020, and the entire disclosure of which is incorporated herein by reference.

BACKGROUND

Technical Field

The subject matter described herein relates to flexible enclosures, such as flexible packages that hold material within the enclosures.

Discussion of Art

Flexible enclosures can hold a variety of material. One example of a flexible enclosure is a pre-formed pouch enclosure that is filled with the material. Stated differently, the pouch enclosure is first formed, and the material is then added to the pouch enclosure. The pouch enclosure is then sealed with the material inside and then may be presented to customers or consumers.

Some pouch enclosures may be difficult to seal after filling with material. For example, stand-up pouches have larger bottoms on which the pouch stands. But, it can be difficult to fill these pouches, as the pouch is usually filled and then a zipper assembly is closed with an additional seal above or outside of the zipper assembly subsequently closed. This can be an additional cost and complexity to providing a full pouch enclosure for customers.

BRIEF DESCRIPTION

In one embodiment, a method includes forming a filling slit in a first panel of web material of a flexible pouch enclosure formed from the first panel and an opposing second panel of the web material and having a resealable closing assembly having mating members joined to a flange, and (after the flexible pouch enclosure is at least partially filled with a product through an opening in the first panel of the web material that is created by the filling slit) closing the filling slit by sealing the first panel to the flange of the resealable closing assembly.

In one embodiment, a method includes forming a filling slit in a first panel of web material of a flexible pouch enclosure formed from the first panel and an opposing second panel of the web material and having a valve through which material inside the flexible pouch enclosure is dispensed, and (after the flexible pouch enclosure is at least partially filled with a product through an opening in the first panel of the web material that is created by the filling slit) closing the filling slit by sealing the first panel to the valve.

In one embodiment, a flexible pouch enclosure includes a first panel of web material, a second panel of the web material that is joined with the first panel to form an interior chamber, and a resealable closing assembly having mating members that couple with each other to close access to the interior chamber and are pulled apart from each other to open access to the interior chamber. The resealable closing assembly has a flange that is coupled with the first panel and the second panel. The first panel includes a filling slit cut through the first panel and through which material in the interior chamber is loaded. The filling slit is sealed shut by sealing the first panel to the flange of the resealable closing assembly.

In one embodiment, a flexible pouch enclosure includes a first panel of web material, a second panel of the web material that is joined with the first panel to form an interior chamber, and a valve coupled with the first panel, the valve providing an opening through which material in the interior chamber is dispensed from the interior chamber. The first panel includes a filling slit cut through the first panel and through which material in the interior chamber is loaded. The filling slit is sealed shut by sealing the first panel to the flange of the valve.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
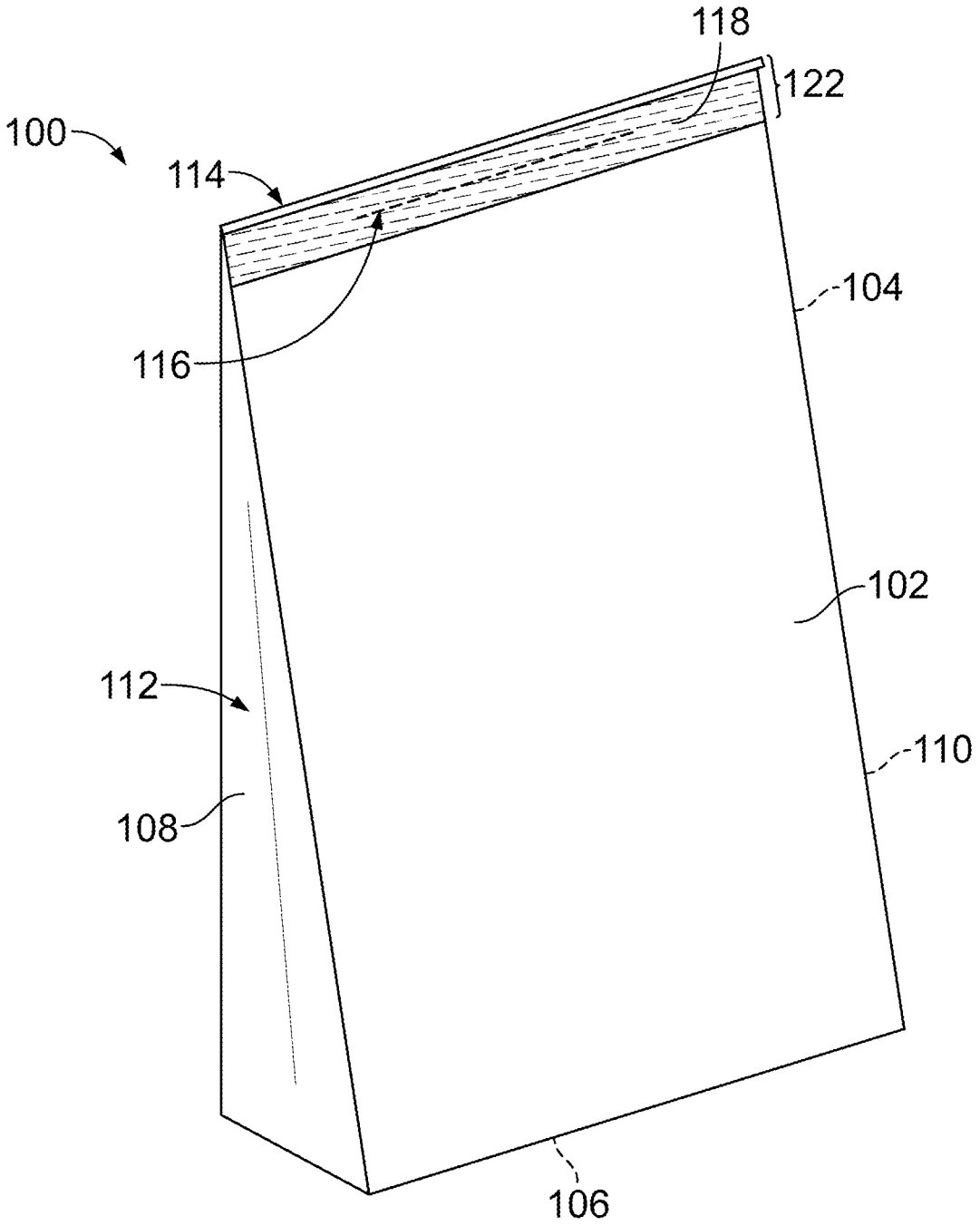
FIG. 1 is a perspective view of one example of a flexible pouch enclosure.

One or more embodiments of the inventive subject matter described herein provide a pouch enclosure with a filling slit formed in the pouch enclosure. The pouch enclosure can be formed from panels of material webs that define an internal chamber or cavity in which material can be placed. The pouch enclosure can be sealed prior to filling with any material such that the internal chamber or cavity of the pouch enclosure is sealed to the external environment. A slit can be formed (e.g., cut) into one of the panels to provide access into the interior of the pouch enclosure. Alternatively, the slit may be formed in the panel(s) before the panels are joined together to form the pouch enclosure.

This slit is not formed along the top edge, bottom side, or sides of the pouch enclosure, but is formed in the front or rear panel in one embodiment. For example, in a pouch enclosure used to hold a material for sale in a store, the slit can be cut into the front face or front panel that faces consumers or the rear panel that faces away from the consumers. But, the slit may not be formed in the left or right sides that join the front and rear panels, or in the top or bottom of the pouch enclosure (in one embodiment).

The material may then be inserted into the pouch enclosure via the opening created by the slit. Once the material is inside the pouch enclosure, the slit can be closed using another component of the pouch enclosure. For example, if the enclosure includes a valve through which a fluid is dispensed from inside the enclosure, then the slit can be formed in the wall or panel of the enclosure within a footprint of a skirt or other extension of the valve. As another example, if the enclosure includes a closing assembly having opposing profiles that allow for repeated opening and closing of the assembly, the slit can be formed in a flange of the closing assembly. The flange of the valve or closing assembly can therefore be used as a patch to seal the slit and the opening formed by the slit closed.

Various bodies or adhesives may be used to seal the slit closed. For example, a different material (e.g., a grip-strip, a resin having a lower melting temperature than the pouch panels, or the like) can be used to seal the slit closed. This can provide for a temperature window or range to be used for allowing heat to be applied to seal the slit shut without sealing other parts of the pouch enclosure together.

Use and sealing of such a filling slit can allow for the pouch enclosure to be more easily filled through various sides of the pouch enclosure other than the top, sides, or bottom of the pouch enclosure (which can be more difficult to fill through due to the smaller size, inability to get the pouch enclosure to stand up during filling, etc.). Additionally, these slits can allow for the filling of small pouches and/or pouches where it may be impractical or undesirable to fill the pouch enclosure through the bottom of the enclosure or, in the case of liquids, near the valve through which the liquids are dispensed out of the pouch enclosure. Additionally, the slits described herein may be sealed without requiring additional materials or bodies to be used to close the openings created by the slits. The thickness of the valve material may require the sides of the slit being sealed so that only the area in the center portion of the slit is sealed to the valve after filling the enclosure (with product or other material).

FIG. 1 is a perspective view of one example of a flexible pouch enclosure 100. The enclosure 100 can define an interior chamber or volume that is bounded by panels of web material. For example, the enclosure 100 can have a front or face panel 102 of a web material (e.g., a polymer sheet) and an opposite rear or back panel 104 of the web material. The panels 102, 104 can be joined by a bottom side 106 of the web material and may be connected with each other by lateral sides 108, 110 of the web material. In one embodiment, one or both of the lateral sides 108, 110 may form a gusset 112 of the enclosure. The panels 102, 104 may be joined with each other at a top edge 114 in the illustrated embodiment. As shown, the bottom side 106 may be flat so that the enclosure 100 can stand upright on its own. The front and back panels 102, 104 may include text, images, or the like, to indicate a dispensable material or product contained within the enclosure 100.

The top edge 114 can include a closing assembly or mechanism 122 that can be repeatedly opened and closed to access and close off access, respectively, to the interior of the enclosure 100. For example, the closing assembly 122 can include opposing profiles that interlock or otherwise mate with each other (by pressing the profiles together, moving a slider along the length of the closing assembly 122, or the like). These profiles can include mating members that mate (e.g., male and female members that interlock) with each other to allow an opening along the top edge 114 of the enclosure 100 to be repeatedly opened and closed. Optionally, the profiles can include hooks, Velcro, resealable adhesives, or the like.

Figure 2:
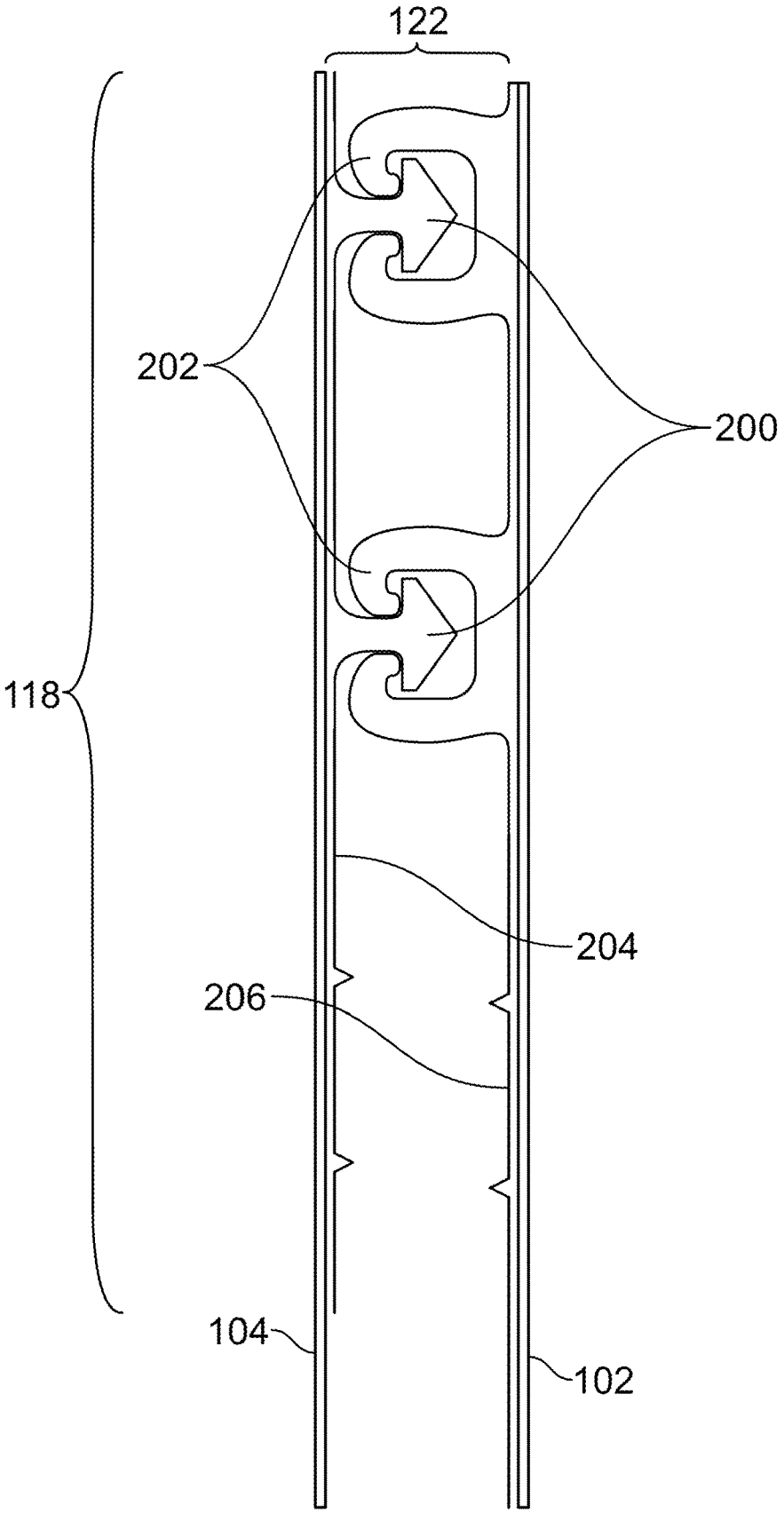
FIG. 2 illustrates a cross-sectional view of one example of a closing assembly shown in FIG. 1.

FIG. 2 illustrates a cross-sectional view of one example of the closing assembly 122. As shown, the closing assembly 122 can include mating members that include arrow-shaped male members 200 and receptacle-shaped female members 202 into which the male members 200 are received. While the closing assembly 122 is shown as having multiple male members 200 on one side and multiple female members 202 on the opposing side, optionally, the closing assembly 122 can include a single male member 200 on one side, a single female member 202 on the opposing side, or a combination of male and female members 200, 202 on each side. The male members 200 and female members 202 may be elongated in and out of the plane of the page of FIG. 2 (e.g., along the length of the top edge 122 of the enclosure 100 shown in FIG. 1). The male members 200 and female members 202 protrude toward each other from corresponding flanges 204, 206. The flanges 204, 206 can extend below and/or above the male members 200 and female members 202. For example, the flanges 204, 206 can extend below the male members 200 and the female members 202 toward the bottom side 106 of the enclosure 100 (shown in FIG. 1). The flanges 204, 206 do not, however, extend to the bottom side 106 of the enclosure 100 in the illustrated example. The flanges 204, 206 may be formed from a different material than the panels 102, 104, such as a material that can be heat sealed to the panels 102, 104. The flanges 204, 206 may be thicker and/or more rigid than the panels 102, 104 in one embodiment. For example, the flange 204, 206 can be formed from a thicker and/or different polymer than the panels 102, 104.

Returning to the description of the enclosure 100 shown in FIG. 1, a filling slit 116 can be cut into the front panel 102 (and/or back panel 104). This slit 116 is shown as a linear cut, but optionally may have a non-linear shape. The slit 116 can be formed by cutting entirely through the panel 102 but not the panel 104 (or, cutting entirely through the panel 104 but not the panel 102). The slit 116 can be cut through the panel 102 or 104 in a location that is over or within a footprint 118 of the flange 204 or 206. The footprint 118 represents an area of the panel 102 (or the panel 104 on the opposite side of the enclosure 100) that overlaps the flange 206 (or the flange 204 on the opposite side of the enclosure 100). The slit 116 can be cut through the panel 102 or 104 within the footprint 118 without the portion of the panel 102, 104 that is below the slit 116 being coupled with the underlying flange 204, 206. For example, the slit 116 may be cut through the panel 102 prior to heat sealing the inside surface of the panel 102 to the flange 206 or prior to heat sealing the portion of the inside surface of the panel 102 that is above the slit 116 to the flange 206.

Figure 3:
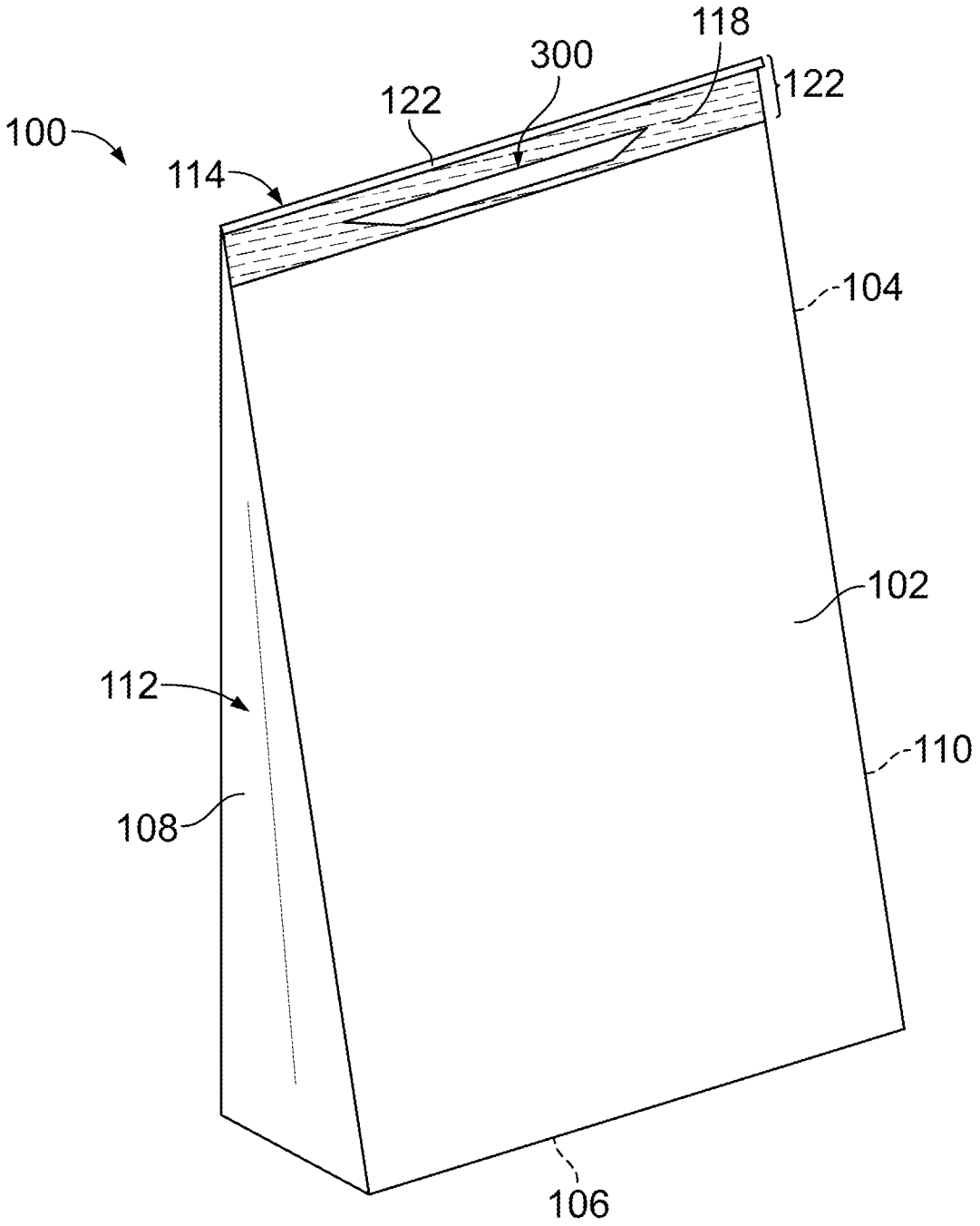
FIG. 3 illustrates another view of the enclosure shown in FIG. 1 with a filling slit opened to form a filling opening into the enclosure according to one embodiment.

FIG. 3 illustrates another view of the enclosure 100 shown in FIG. 1 with the slit 116 opened to form a filling opening 300 into the enclosure 100 according to one embodiment. The opening 300 can be formed by pulling the portion of the panel 102 that is below the slit 116 away from the interior of the enclosure 100. A dispensable material or product can be loaded into the interior chamber of the enclosure 100 through the opening 300. For example, a spout, nozzle, or the like, can be inserted into the opening 300 to fill the enclosure 100 with the product or material. The material can be loaded into the enclosure 100 through the opening 300 without opening the top edge 114 or closing assembly 122, or by forming any other opening in the enclosure 100.

Once the material is placed into the enclosure 100, the slit 116 may be sealed shut to prevent access to the interior of the enclosure 100 through the slit 116. For example, the slit 116 may be sealed such that access to the interior of the enclosure 100 may only be obtained through the closing assembly 122 along the top edge 114 (without damaging or destroying the enclosure 100).

Figures 4, 5, 6:
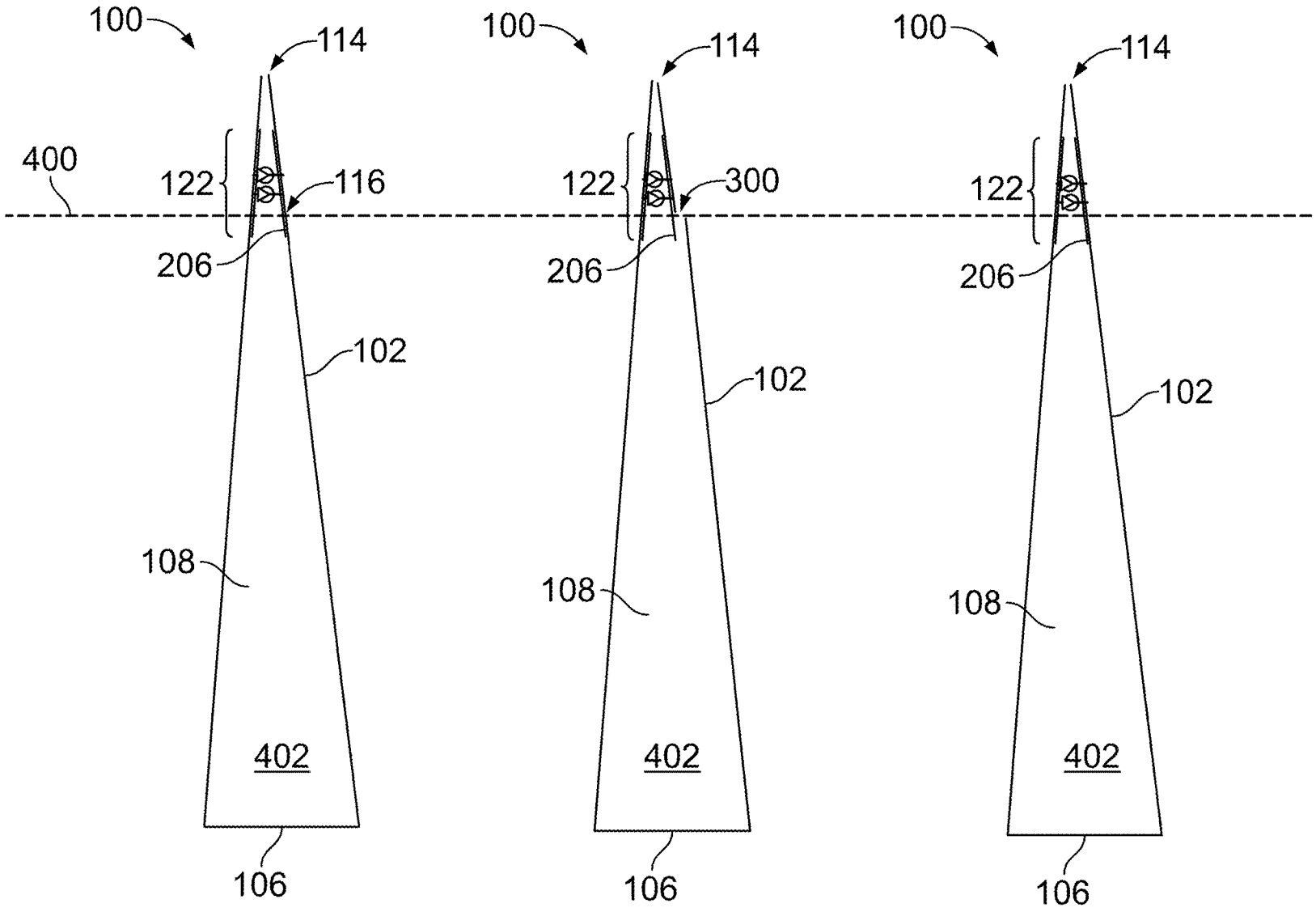
FIG. 4 illustrates a side view of the enclosure shown in FIG. 1.
FIG. 5 illustrates another side view of the enclosure shown in FIG. 1.
FIG. 6 illustrates another side view of the enclosure shown in FIG. 1.

FIGS. 4 through 6 illustrate side views of the enclosure 100. These Figures illustrate how the slit 116 can be created and then sealed. A cut line 400 is shown across FIGS. 4 through 6 to represent where the slit 116 is formed in the front panel 102. FIG. 5 shows the opening 300 that is formed by the slit 116 that provides access to an interior chamber 402 of the enclosure 100 where the material is placed via the opening 300.

The portion of the panel 102 that is above the cut line 400 may be sealed to the flange 206 before forming the slit 116 or may not be sealed to the flange 206 before forming the slit 116. After forming the slit 116 and filling the interior chamber 402 via the opening 300 formed by the slit 116, the lower portion of the panel 102 that is below the cut line 400 may be sealed to the flange 206. For example, the panel 102 below the slit 116 (and optionally above the slit 116 if not already sealed) may be heat sealed to the flange 206. This results in the panel 102 being sealed to the flange 206 of the closing assembly 122 above and below the slit 116. This closes the opening 300 and the slit 116 to prevent material inside the enclosure 100 from exiting the enclosure 100 via the slit 116.

The slit 116 is sealed to prevent the material inside the enclosure 100 from exiting the enclosure 100 via the slit 116 and to prevent entry into the enclosure via the slit 116. The material inside the enclosure 100 may be accessed by opening the enclosure 100 (e.g., via the closing assembly 122 along the top edge 114 of the enclosure). For example, opening the closing assembly 122 can open a primary opening into which a consumer may access the material inside the enclosure 100, whereas the slit 116 may only be used to initially fill the enclosure 100.

Figure 7:
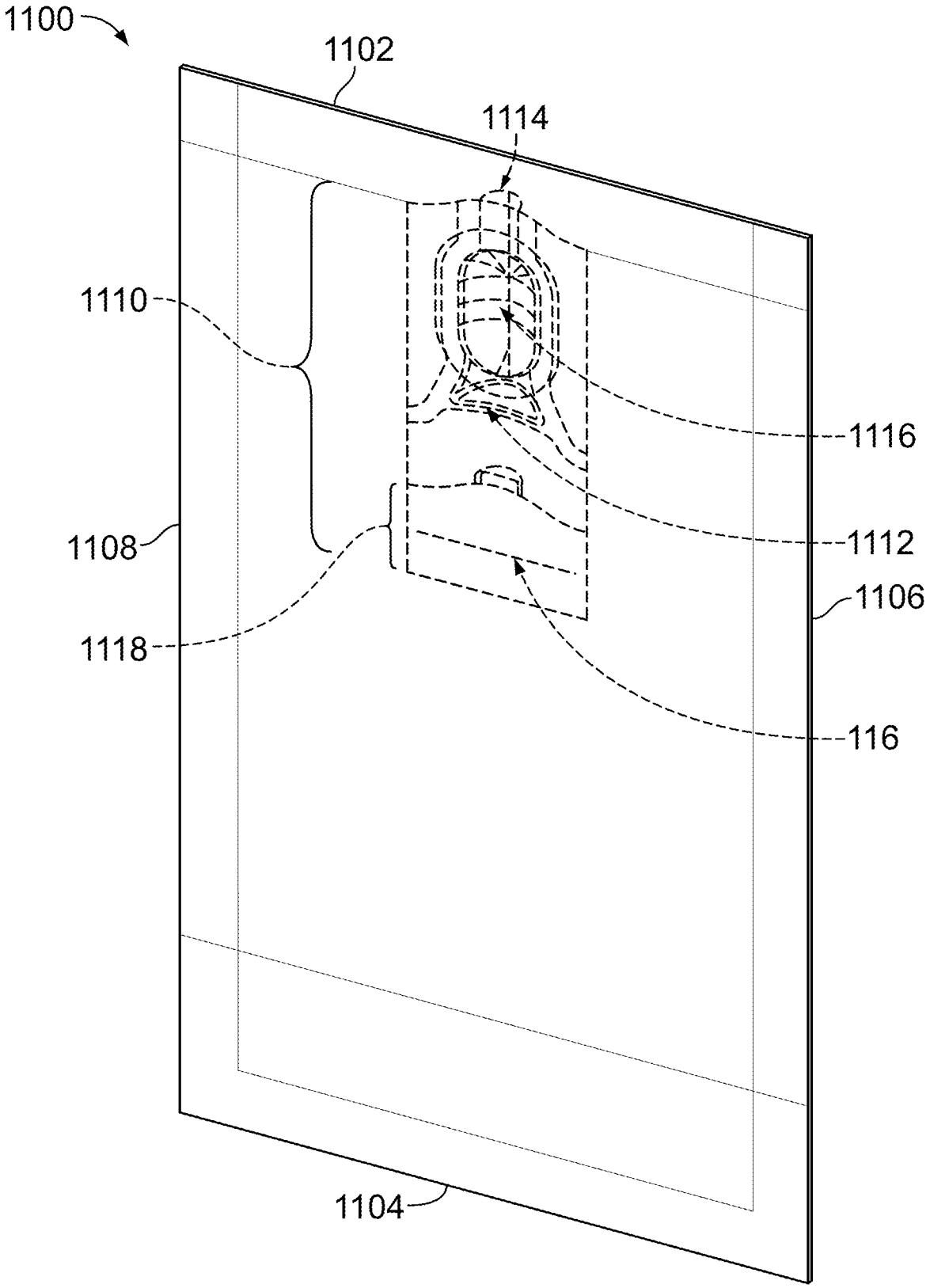
FIG. 7 illustrates a back or interior side of a front panel for a flexible enclosure having a valve over a slit in the enclosure.
Figure 8:
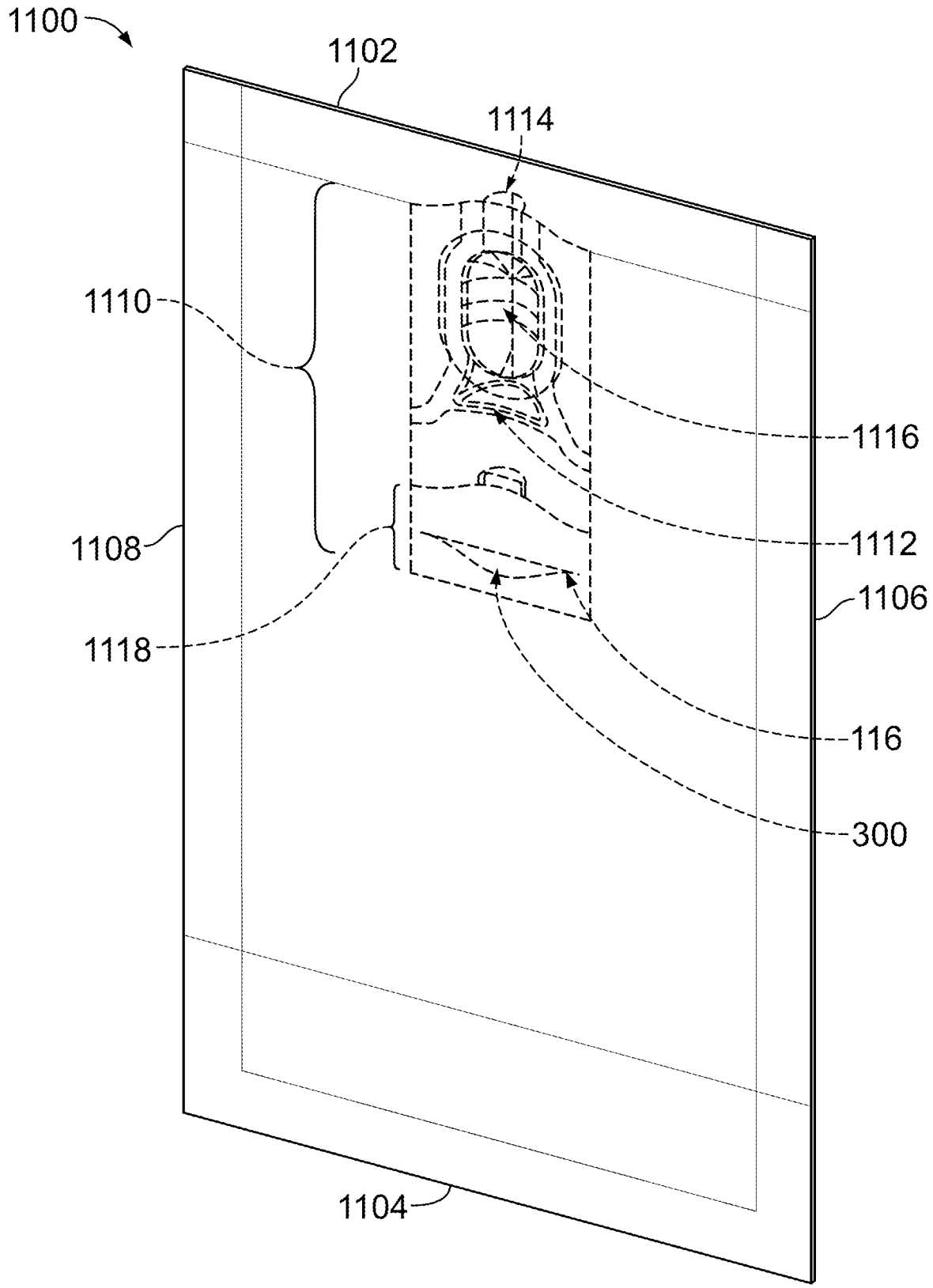
FIG. 8 also illustrates the back or interior side of the front panel shown in FIG. 7.

FIGS. 7 and 8 illustrate a back or interior side of a front panel 1100 for a flexible enclosure. The front panel 1100 may be used in place of the front panel 102 of the enclosure 100 shown in FIG. 1. For example, the front panel 1100 has a top edge 1102 that may extend along and be coupled with the back panel 104 of the enclosure 100 along the top edge 114 (shown in FIG. 1). The front panel 1100 has an opposite bottom edge 1104 that may extend along and be coupled with the bottom side 106 (shown in FIG. 1) of the enclosure 100. The front panel 1100 includes a left edge 1106 that may extend along and be coupled with the side 108 (shown in FIG. 1) of the enclosure 100 and an opposite right edge 1108 that may extend along and be coupled with the side 110 (shown in FIG. 1) of the enclosure 100. The front panel 1100 may replace the front panel 102 with one difference being that there is no closing assembly 122 or other opening accessible along the top edge 114 of the enclosure 100 having the front panel 1100. Instead, the front panel 1100 includes a valve 1110 through which a fluid (e.g., a liquid) or other material inside the enclosure 100 may be dispensed. The valve 1110 includes an interior opening 1112 that is open to the interior chamber 402 of the enclosure 100, an exterior opening 1114 through which material inside the chamber 400 of the enclosure 100 may be dispensed out of the enclosure 100, and an interior conduit 1116 that fluidly couples with interior opening 1112 and the exterior opening 1114.

The valve 1110 includes a flange 1118 that is coupled with the front panel 1100. The valve 1110 and the flange 1118 can be formed from a polymer or other material that is heat sealed or adhered to the front panel 1100 (e.g., using one or more adhesives). For example, the flange 1118 may be heat sealed or adhered to the front side or back (interior) side of the front panel 1100. The flange 1118 is a planar extension of the valve 1110 that extends or protrudes beyond the opening 1112 in the illustrated embodiment. Alternatively, the flange 1118 can extend or protrude in another direction.

The valve 1110 can be sealed to the panel 1100 by applying heat and/or pressure to the valve 1110 (at or near the edges of the valve 1110) using seal bars one or more times. These seal bars can seal the four edges of the valve 1110 to the panel 1100 at the same time or at different times. The center portion of the panel 1100 that is above (or below) the slit 116 can be sealed to the panel 1100 in one or more locations between the opposite lateral edges of the valve 1110 (at the same time as the edges of the valve 1110 or at another time).

Additionally, if the resealable closing assembly is provided to resealing open and close the slit 116, then a crush area of this closing assembly may need to be a different thickness than a remainder of the closing assembly. For example, the opposite ends of the closing assembly may need to be thinner than the middle or intermediate portion of the closing assembly. This can help maintain a seal between the valve 1110 and the panel 1100. Optionally, a transitional seal extending from the crush area(s) toward the center or middle of the closing assembly may be provided to improve the sealing of the valve 1110 across the entire slit 116.

In the illustrated embodiment, the filling slit 116 is cut through the web material of the front panel 1100 in a location that is covered by the flange 1118. FIG. 8 shows the filling slit 116 pulled open to establish the opening 300 through which the material (e.g., liquid) can be loaded into the interior chamber 402 of the enclosure 100. Once the material is loaded into the enclosure 100, the filling slit 1116 can be sealed shut, but as by sealing or adhering the flange 1118 of the valve 1110 to the front panel 1100.

For example, the flange 1118 of the valve 1110 may be coupled to the upper or lower portion 118, 120 of the front panel 1100 above or below the filling slit 116. The other of the upper or lower portion 118, 120 of the front panel 1100 may not be coupled with the flange 1118 of the valve 1110. This can allow for the opening 300 created by the filling slit 116 to remain open for loading of the material into the enclosure 100. Once the enclosure 100 has the material inside the enclosure 100, the upper or lower portion 118, 120 of the front panel 1100 that was not coupled with the flange 1118 of the valve 1110 may be sealed to the flange 1118. This seals the flange 1118 over the filling slit 116 to close the filling slit 116.

As another example, the valve 1110 may be coupled with the front panel 1100 but with the flange 1118 not sealed over the filling slit 116 to allow for material to be loaded into the enclosure 100 via the filling slit 116. Once the material is loaded into the enclosure 100, the flange 1118 may be sealed to the front panel 1100 over the filling slit 116 to seal the filling slit 116 closed. The material may then be dispensed out of the enclosure 100 via the valve 1110. Alternatively, the valve 1110 may not be coupled to the front panel 1100 until after the material is loaded into the enclosure 100 via the filling slit 116. The valve 1110 may then be coupled with the front panel 1100 with the flange 1118 sealed to the front panel 1100 over the filling slit 116. This can seal the filling slit 116 closed.

Figure 9:
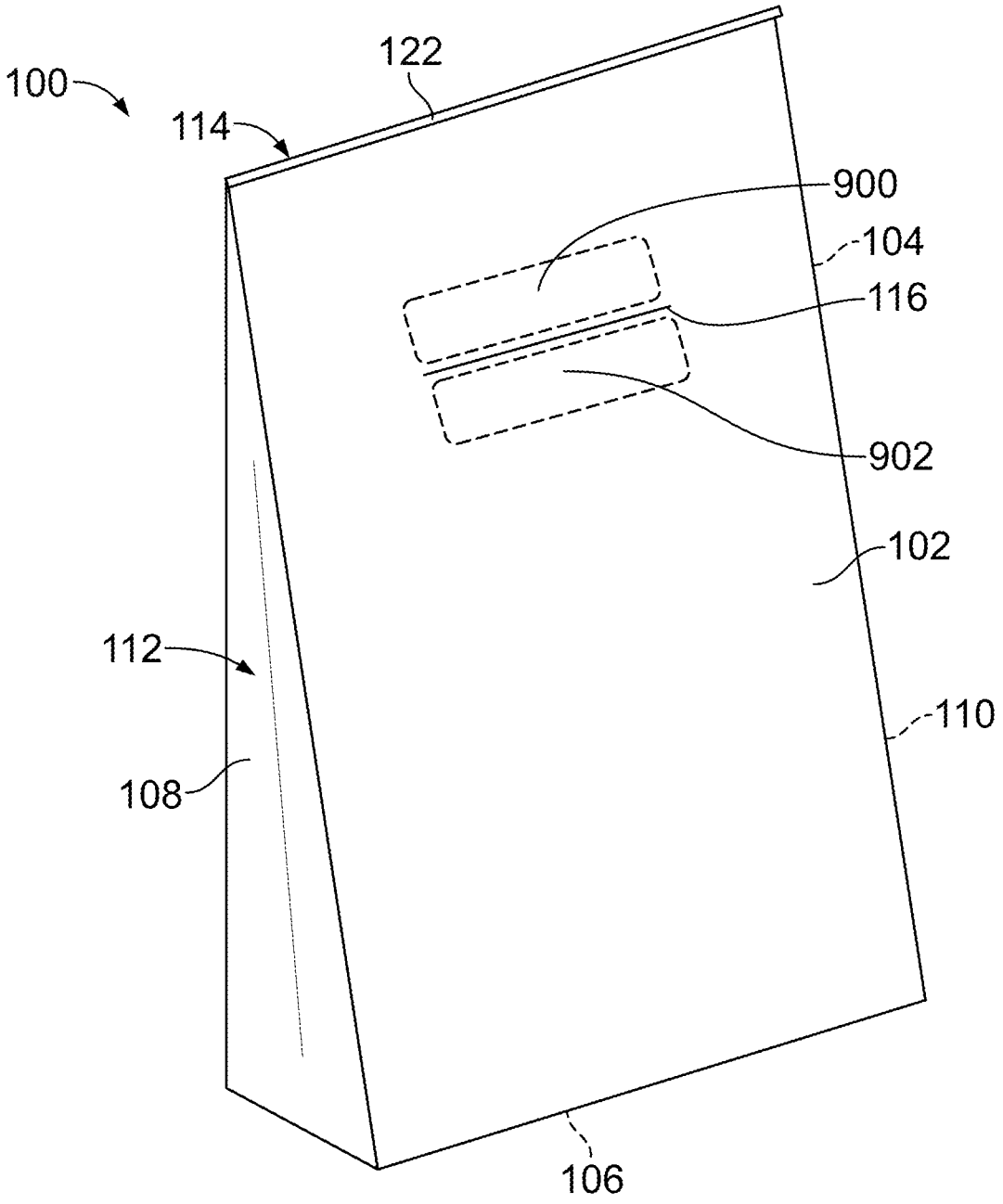
FIG. 9 is a perspective view of another example of the enclosure shown in FIG. 1.

FIG. 9 is a perspective view of another example of the enclosure 100. In contrast to the example of the enclosure 100 shown in FIGS. 1 through 8, the filling slit 116 can be cut into the front panel 102 (or back panel 104) in a location that is not within the footprint of the flange of a closing assembly 122 or the flange of a valve. Instead, the slit 116 can be cut into the panel 102 or 104 in a location without any underlying material. The slit 116 separates an upper portion 900 of the panel 102 from a lower portion 902 of the panel 102, with the portions 900, 902 being areas or the panel 102 that are directly above and below, respectively, the slit 116 (e.g., up to a centimeter or two above the slit 116 for the portion 900 and up to a centimeter or two below the slit 116 for the portion 902).

Figure 10:
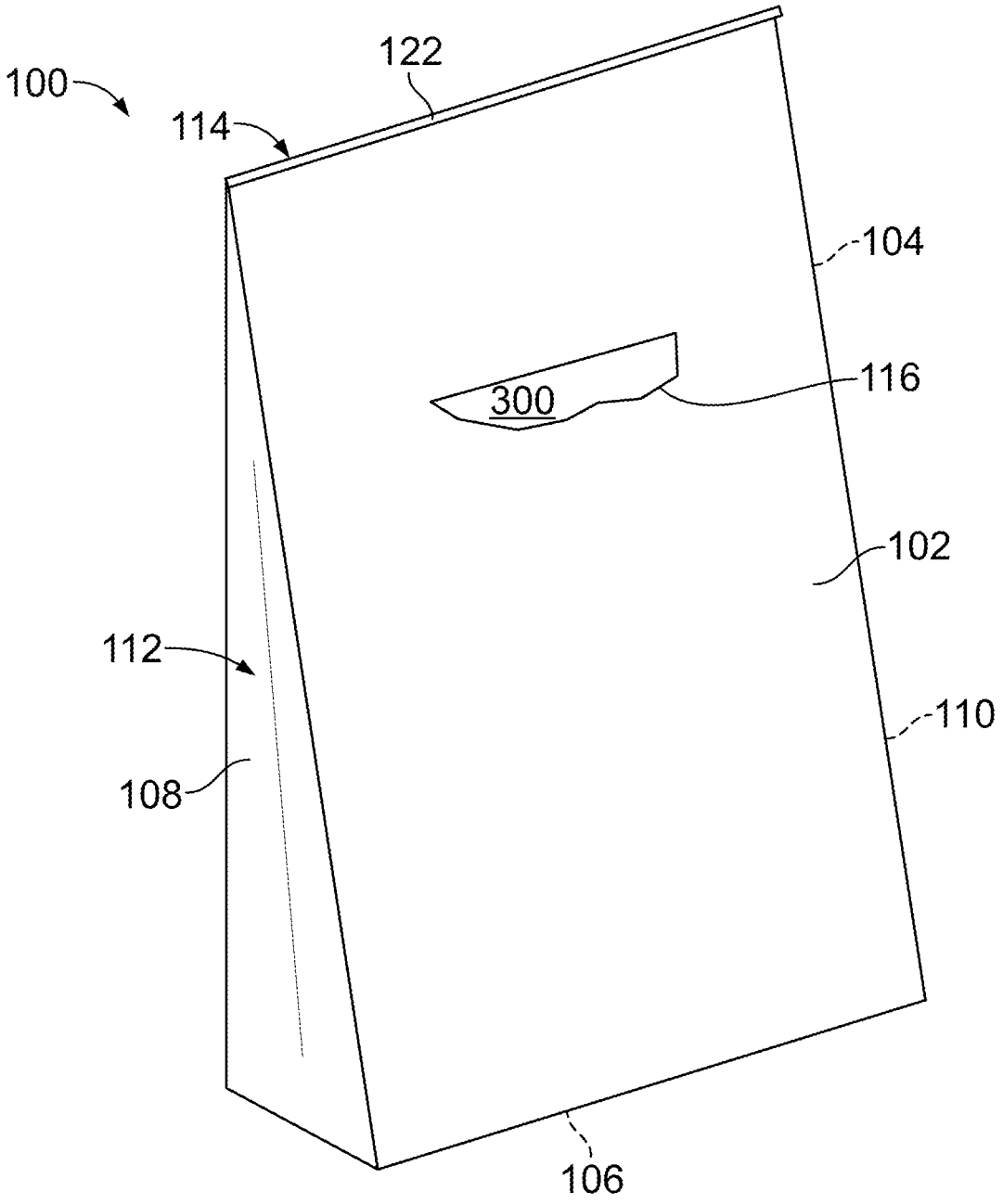
FIG. 10 illustrates another view of the enclosure shown in FIG. 1 with a slit opened to form a filling opening into the enclosure.

FIG. 10 illustrates another view of the enclosure 100 shown in FIG. 1 with the slit 116 opened to form the filling opening 300 into the enclosure 100 according to one embodiment. The opening 300 can be formed by pulling the portions 900, 902 of the panel 102 away from each other. The dispensable material or product can be loaded into the interior chamber of the enclosure 100 through the opening 300. For example, a spout, nozzle, or the like, can be inserted into the opening 300 to fill the enclosure 100 with the product or material. The material can be loaded into the enclosure 100 through the opening 300 without opening the top edge 114 or closing assembly 122, or by forming any other opening in the enclosure 100.

Once the material is placed into the enclosure 100, the slit 116 may be sealed shut to prevent access to the interior of the enclosure 100 through the slit 116. For example, the slit 116 may be sealed such that access to the interior of the enclosure 100 may only be obtained through the closing assembly 122 along the top edge 114 (without damaging or destroying the enclosure 100). In one embodiment, the top portion 900 of the front panel 102 can be pulled down to overlap the lower portion 902 of the front panel 102. The overlapping top portion 900 can then be sealed to the lower portion 902 to close the slit 116. As another example, the bottom portion 902 of the front panel 102 can be pulled up to overlap the upper portion 900 of the front panel 102. The overlapping lower portion 902 can then be sealed to the upper portion 900 to close the slit 116.

Figures 11, 12, 13:
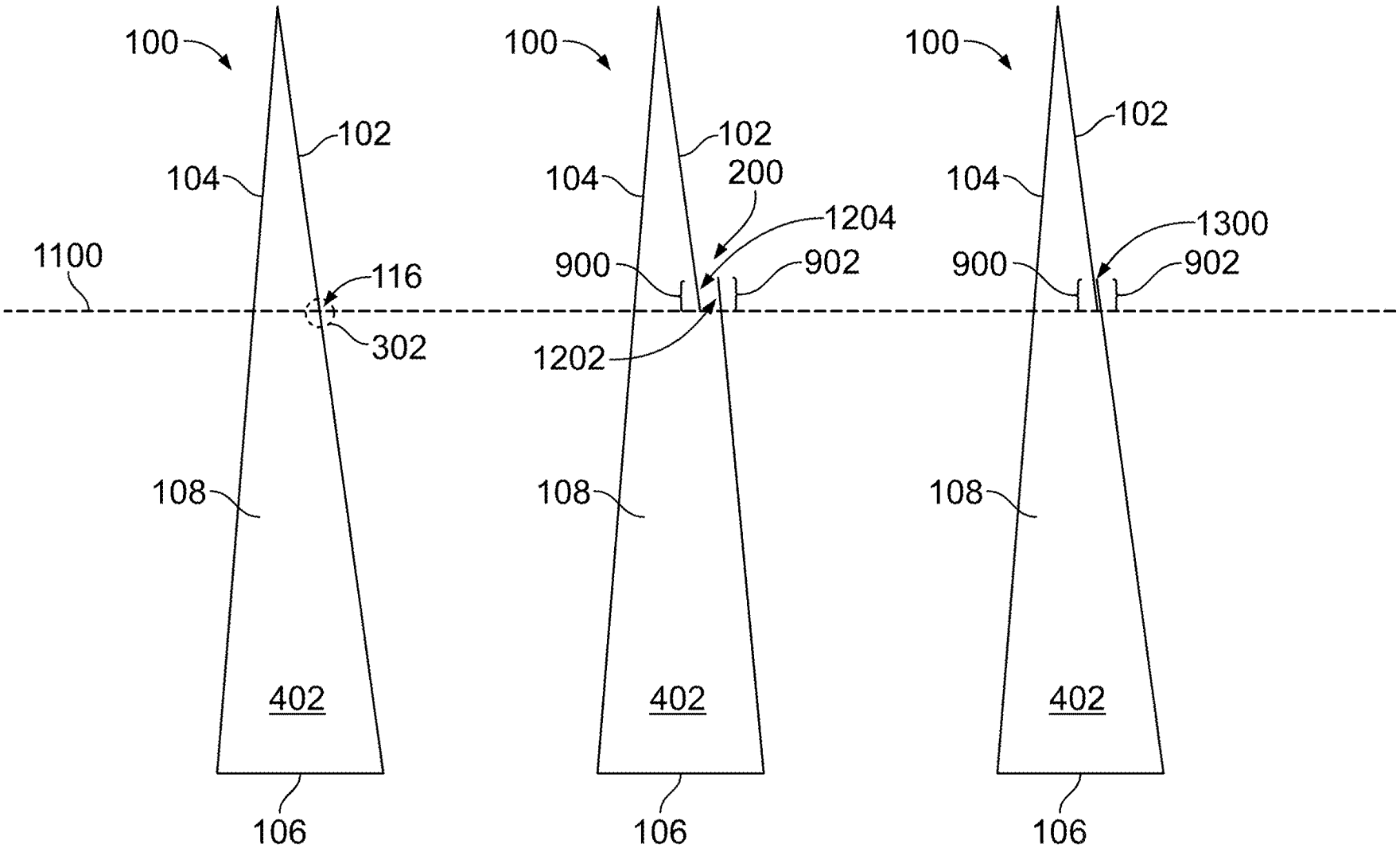
FIG. 11 illustrates a side view of the enclosure shown in FIGS. 9 and 10.
FIG. 12 illustrates a side view of the enclosure shown in FIGS. 9 and 10.
FIG. 13 illustrates a side view of the enclosure shown in FIGS. 9 and 10.

FIGS. 11 through 13 illustrate side views of the enclosure 100 shown in FIGS. 9 and 10. These Figures illustrate how the slit 116 can be sealed. A cut line 1100 is shown across FIGS. 11 through 13 to represent where the slit 116 is formed in the front panel 102, with a circle 302 shown in FIG. 11 to show the location of the slit 116 in the front panel 102. FIG. 12 shows the opening 300 that is formed by the slit 116 that provides access to the interior chamber 402 of the enclosure 100 where the material is placed via the opening 300. As shown in FIG. 12, the bottom portion 902 of the front panel 102 below the slit 116 can be pulled upward such that the bottom portion 902 is pulled above the cut line 1100 where the slit 116 was formed.

Pulling the bottom portion 902 up above the cut line 1100 forms an overlap between the portions 900, 902 of the front panel 102. For example, the overlap may be an area of a back or inner surface 1202 of the bottom portion 902 of the front panel 102 that faces or opposes a front or outer surface 1204 of the upper portion 900 of the front panel 102. The overlapping areas of the upper and bottom portions 900, 902 of the front panel 102 can then be sealed to each other. For example, the back surface 1202 of the bottom portion 902 and the front surface 1204 of the upper portion 900 can be placed in contact with each other and then heated to heat seal the back surface 1202 of the bottom portion 902 to the front surface 1204 of the upper portion 900. This forms a seal 1300 that closes the slit 116, as shown in FIG. 13. As another example, an adhesive can be added to the back surface 1202 of the bottom portion 902 and/or the front surface 1204 of the upper portion 900 of the front panel 102. The back surface 1202 of the bottom portion 902 and the front surface 1204 of the upper portion 900 can then be adhered together to form the seal 1300 that closes the slit 116.

Figures 14, 15, 16:
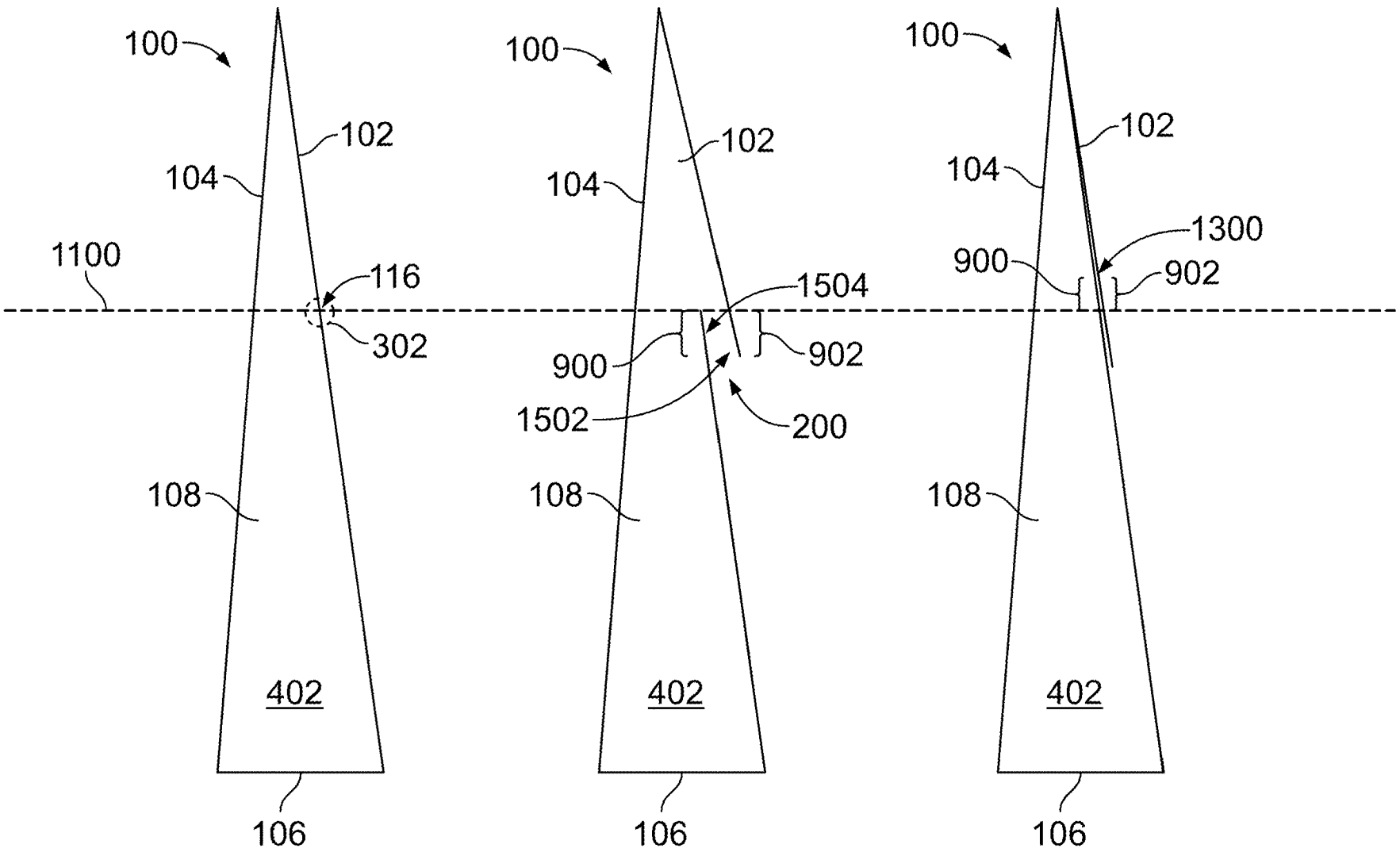
FIG. 14 illustrates a side view of the enclosure shown in FIG. 1.
FIG. 15 illustrates a side view of the enclosure shown in FIG. 1.
FIG. 16 illustrates a side view of the enclosure shown in FIG. 1.

FIGS. 14 through 16 illustrate additional side views of the enclosure 100. These Figures illustrate another manner in which the slit 116 can be sealed. The cut line 1100 is shown across FIGS. 14 through 16 to represent where the slit 116 is formed in the front panel 102. In the example illustrated in FIGS. 14 through 16, the upper portion 900 of the front panel 102 is pulled down below the slit 116 such that the upper portion 900 is pulled below the cut line 1100 where the slit 116 was formed. Pulling the upper portion 900 down below the cut line 1100 forms an overlap between the portions 900, 902 of the front panel 102, similar to as described above in connection with FIGS. 11 through 13. In contrast to the overlap formed by pulling the lower portion 902 above the location where the slit 116 was formed, the overlap in FIGS. 14 through 16 is formed between a front surface 1504 of the upper portion 900 of the front panel 102 and a back or inner surface 1502 of the lower portion 902 of the front panel 102. The front or outer surfaces 1204, 1504 of the front panel 102 can face outside of the enclosure 100 while the back or inner surfaces 1202, 1502 of the front panel 102 face inside the enclosure 100 (e.g., in an opposite direction than the front or outer surfaces 1204, 1504). The overlapping areas of the upper and bottom portions 900, 902 of the front panel 102 can then be sealed to each other, as described above.

Figure 17:
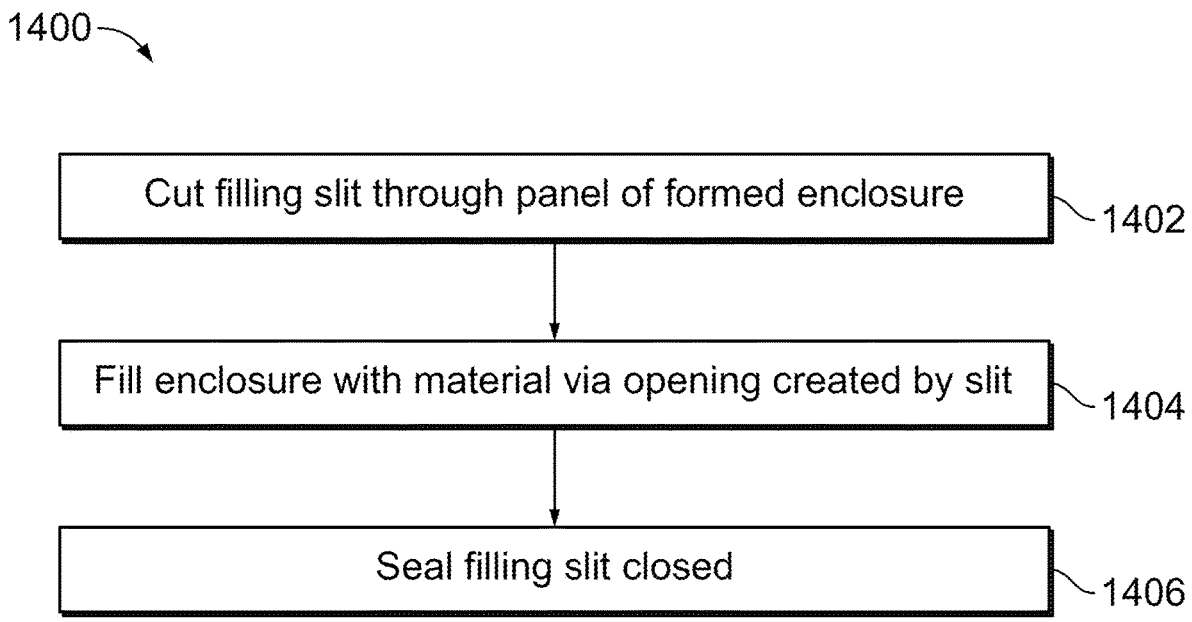
FIG. 17 illustrates a flowchart of one example of a method for filling a flexible enclosure with a material.

FIG. 17 illustrates a flowchart of one example of a method 1400 for filling a flexible enclosure with a material. The method 1400 can represent operations performed to at least partially fill one or more of the enclosures described herein with a material. At 1402, a filling slit is cut through part of the enclosure. For example, a cut may be made through an enclosure that is fully formed. The enclosure may be fully formed in that the enclosure can bound and enclose an interior chamber before the slit is cut into a panel of the enclosure. The slit can be cut through part of the panel that is within a footprint of a flange of a closing assembly. Optionally, the slit can be cut through part of the panel that is within a footprint of a flange of a valve. At 1404, material is inserted into the enclosure via the slit. For example, the enclosure may be at least partially filled with material through an opening formed by the slit. At 1406, the slit is closed. For example, the slit can be sealed shut by heat sealing part of the panel that is above and/or below the slit to the flange of the closing assembly and/or the valve.

The material inside the enclosure may then be accessed (e.g., by a purchaser) through an opening other than the opening provided by the slit. For example, the enclosure may include a re-closeable zipper, a valve, or the like, through which the material inside the enclosure may be dispensed.

In one embodiment, a method includes forming a filling slit in a first panel of web material of a flexible pouch enclosure formed from the first panel and an opposing second panel of the web material and having a resealable closing assembly having interlocking male and female members joined to a flange, and (after the flexible pouch enclosure is at least partially filled with a product through an opening in the first panel of the web material that is created by the filling slit) closing the filling slit by sealing the first panel to the flange of the resealable closing assembly.

Optionally, the flexible pouch enclosure includes an opening apart from the filling slit through which the product is accessible. The opening can be accessible by pulling the male and female members of the resealable closing assembly apart from each other.

Optionally, the flexible pouch enclosure is sealed shut with none of the product inside the flexible pouch enclosure prior to the filling slit being formed in the first panel of the web material.

Optionally, the filling slit is formed by cutting through the first panel within a footprint of the flange of the resealable closing assembly.

Optionally, the filling slit is formed by cutting through the first panel such that an upper portion of the first panel that is above the filling slit remains sealed to the flange of the resealable closing assembly and a lower portion of the first panel that is below the filling slit is not sealed to the flange of the resealable closing assembly.

Optionally, the filling slit is closed by sealing the lower portion of the panel to the flange.

Optionally, the filling slit is closed by heat sealing an inner surface of the first panel to the flange of the resealable closing assembly.

In one embodiment, a method includes forming a filling slit in a first panel of web material of a flexible pouch enclosure formed from the first panel and an opposing second panel of the web material and having a valve through which material inside the flexible pouch enclosure is dispensed, and (after the flexible pouch enclosure is at least partially filled with a product through an opening in the first panel of the web material that is created by the filling slit) closing the filling slit by sealing the first panel to the valve.

Optionally, the flexible pouch enclosure is sealed shut with none of the product inside the flexible pouch enclosure prior to the filling slit being formed in the first panel of the web material.

Optionally, the filling slit is formed by cutting through the first panel within a footprint of a flange of the valve.

Optionally, the flange of the valve is sealed to an interior surface of the first panel.

Optionally, the filling slit is formed by cutting through the first panel such that an upper portion of the first panel that is above the filling slit remains sealed to the flange of the valve and a lower portion of the first panel that is below the filling slit is not sealed to the flange of the valve.

Optionally, the filling slit is closed by sealing the lower portion of the panel to the flange.

In one embodiment, a flexible pouch enclosure includes a first panel of web material, a second panel of the web material that is joined with the first panel to form an interior chamber, and a resealable closing assembly having interlocking male and female members that couple with each other to close access to the interior chamber and are pulled apart from each other to open access to the interior chamber. The resealable closing assembly has a flange that is coupled with the first panel and the second panel. The first panel includes a filling slit cut through the first panel and through which material in the interior chamber is loaded. The filling slit is sealed shut by sealing the first panel to the flange of the resealable closing assembly.

Optionally, the flexible pouch enclosure is sealed shut with none of the material inside the flexible pouch enclosure prior to the filling slit being formed in the first panel of the web material.

Optionally, the filling slit is formed through the first panel within a footprint of the flange of the resealable closing assembly.

Optionally, the first panel has an upper portion located above the filling slit that remains sealed to the flange of the resealable closing assembly and a lower portion that is below the filling slit and that is not sealed to the flange of the resealable closing assembly prior to loading of the material into the interior chamber via the filling slit.

Optionally, the lower portion of the first panel is heat sealed to the flange.

In one embodiment, a flexible pouch enclosure includes a first panel of web material, a second panel of the web material that is joined with the first panel to form an interior chamber, and a valve coupled with the first panel, the valve providing an opening through which material in the interior chamber is dispensed from the interior chamber. The first panel includes a filling slit cut through the first panel and through which material in the interior chamber is loaded. The filling slit is sealed shut by sealing the first panel to the flange of the valve.

Optionally, the flexible pouch enclosure is sealed shut with none of the material inside the flexible pouch enclosure prior to the filling slit being formed in the first panel of the web material.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

forming a filling slit in a first panel of web material of a flexible pouch enclosure formed from the first panel and an opposing second panel of the web material and having a valve with a flange, the filling slit formed by cutting through the first panel within a footprint of the flange of the valve; and after the flexible pouch enclosure is at least partially filled with a product through an opening in the first panel of the web material that is created by the filling slit, closing the filling slit by sealing the first panel to the flange of the valve.

2. The method of claim 1, wherein the flexible pouch enclosure is sealed shut with none of the product inside the flexible pouch enclosure prior to the filling slit being formed in the first panel of the web material.

3. The method of claim 1, wherein the filling slit is formed by cutting through the first panel such that an upper portion of the first panel that is above the filling slit remains sealed to the flange of the valve and a lower portion of the first panel that is below the filling slit is not sealed to the flange of the valve.

4. The method of claim 3, wherein the filling slit is closed by sealing the lower portion of the first panel to the flange.

5. The method of claim 1, wherein the filling slit is closed by heat sealing an inner surface of the first panel to the flange of the valve.

6. A method comprising:

forming a filling slit in a first panel of web material of a flexible pouch enclosure formed from the first panel and an opposing second panel of the web material and having a valve through which a product inside the flexible pouch enclosure is dispensed; and after the flexible pouch enclosure is at least partially filled with the product through an opening in the first panel of the web material that is created by the filling slit, closing the filling slit by sealing the first panel to the valve.

7. The method of claim 6, wherein the flexible pouch enclosure is sealed shut with none of the product inside the flexible pouch enclosure prior to the filling slit being formed in the first panel of the web material.

8. The method of claim 6, wherein the filling slit is formed by cutting through the first panel within a footprint of a flange of the valve.

9. The method of claim 8, wherein the flange of the valve is sealed to an interior surface of the first panel.

10. The method of claim 8, wherein the filling slit is formed by cutting through the first panel such that an upper portion of the first panel that is above the filling slit remains sealed to the flange of the valve and a lower portion of the first panel that is below the filling slit is not sealed to the flange of the valve.

11. The method of claim 10, wherein the filling slit is closed by sealing the lower portion of the first panel to the flange.

12. The method of claim 6, wherein the first panel is sealed to the valve using an adhesive having a lower melting temperature than the first panel.

13. A flexible pouch enclosure comprising:

a first panel of web material;

a second panel of the web material that is joined with the first panel to form an interior chamber; and a valve having a flange that is coupled with the first panel, wherein the first panel includes a filling slit cut through the first panel and through which material in the interior chamber is loaded, the filling slit positioned to be sealed shut by sealing the first panel to the flange of the valve, the filling slit formed through the first panel within a footprint of the flange of the valve.

14. The flexible pouch enclosure of claim 13, wherein the first panel has an upper portion located above the filling slit that remains sealed to the flange of the valve and a lower portion that is below the filling slit and that is not sealed to the flange of the valve prior to loading of the material into the interior chamber via the filling slit.

15. The flexible pouch enclosure of claim 14, wherein the filling slit is positioned and configured to be sealed shut by heat sealing the lower portion of the first panel to the flange of the first panel is heat sealed to the flange.

16. A flexible pouch enclosure comprising:

a first panel of web material;

a second panel of the web material that is joined with the first panel to form an interior chamber; and a valve coupled with the first panel, the valve providing an opening through which material in the interior chamber is dispensed from the interior chamber, wherein the first panel includes a filling slit cut through the first panel and through which the material in the interior chamber is loaded, the filling slit positioned to be sealed shut by sealing the first panel to the valve.

* * * * *